United States Patent [19]

Adam

[11] Patent Number: 4,575,083

[45] Date of Patent: Mar. 11, 1986

[54] RACKET WITH ELASTIC VIBRATION DAMPING STRIP

[75] Inventor: Günter Adam, Straubing, Fed. Rep. of Germany

[73] Assignee: Puma-KG, Fed. Rep. of Germany

[21] Appl. No.: 627,544

[22] Filed: Jul. 3, 1984

[30] Foreign Application Priority Data

Jul. 5, 1983 [DE] Fed. Rep. of Germany ..... 3324142

[51] Int. Cl.[4] ..... A63B 49/00

[52] U.S. Cl. ..... 273/73 D

[58] Field of Search ..... 273/73 R, 73 C, 73 D, 273/73 E

[56] References Cited

U.S. PATENT DOCUMENTS 2,732,209 1/1956 Forbes ..... 273/73 R

FOREIGN PATENT DOCUMENTS 463997 7/1928 Fed. Rep. of Germany .... 273/73 R
2501659 7/1976 Fed. Rep. of Germany ... 273/73 D
2752673 5/1979 Fed. Rep. of Germany ... 273/73 D

*Primary Examiner*—Richard C. Pinkham
*Assistant Examiner*—Matthew L. Schneider
*Attorney, Agent, or Firm*—Sixbey, Friedman & Leedom

[57] ABSTRACT

A racket, especially a tennis racket having an elastic strip clamped in the edge area of the strung hitting surface through alternate crossing points of respective longitudinal and transverse strings and parallel to one of the strings or through diagonally adjacent crossing points of the strings. The strip is attached to the racket in a manner so that it can be detached at any time. The elastic strip serves the purpose of decreasing string vibrations during hitting of the ball.

17 Claims, 2 Drawing Figures

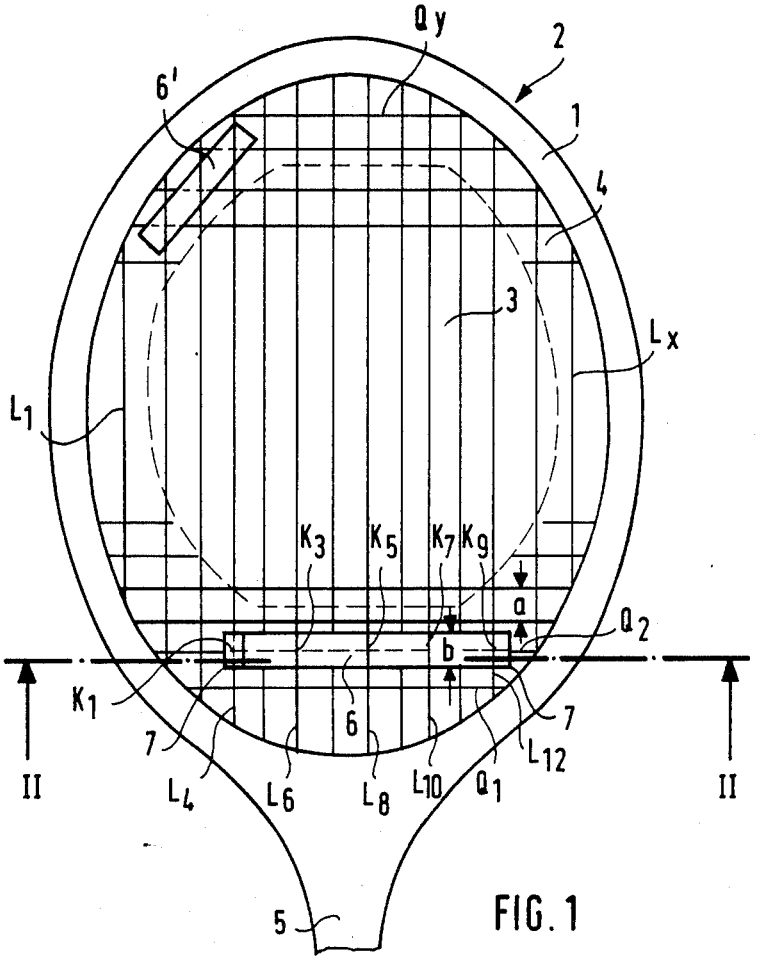
FIG. 1
FIG. 2
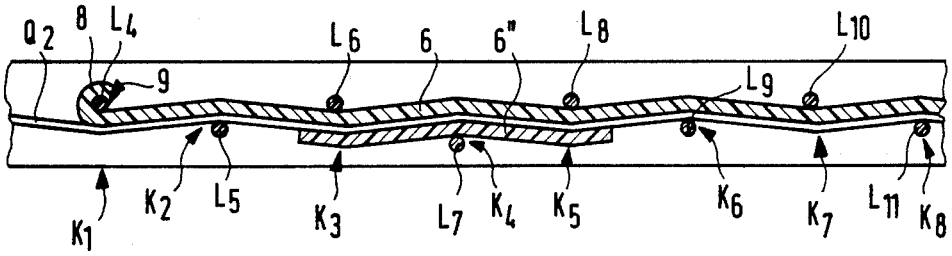

RACKET WITH ELASTIC VIBRATION DAMPING STRIP

BACKGROUND AND SUMMARY OF THE INVENTION

This invention relates to a racket, especially a tennis racket, having a hitting area strung with longitudinal and transverse strings and having at least one removable damping means for the damping of string vibrations.

A racket of this type is known from DE-OS No. 28 06 061. In this known racket, two or more strings are coupled at locations spaced from the string crossing points. For this purpose, coupling elements are used made of an elastomer material having elastic self-damping characteristics, such as natural or synthetic rubber, or worm springs or spiral springs which, at the ends, wind around two adjacent strings and thus mechanically couple them with one another. In order to achieve a sufficient damping effect, several of such coupling elements are preferably mounted. In the case of one of the coupling elements, the ends are folded over the strings, in which case it may subsequently be arranged at a desired spot of the hitting surface between two strings. In addition, the coupling elements are developed in such a way that they deform the adjacent strings with respect to one another; i.e., by means of the coupling element, the strings are pulled toward one another or pressed apart. The coupling elements must therefore be formed in correspondence to the distance between the strings.

In U.S. Pat. No. 2,732,209 disclosed a racket with corrugated wire stringing in place of the conventional plastic or gut stringing. In view of the fact that the metallic strings produce a ringing sound when struck against by a ball, shuttle-cock or other objects, a deadening material in the form of rubber-like strips are applied to the stringing to prevent vibration thereof. Those strips have hook-like ends. The hook-like ends engage the first and last transverse or longitudinal strings with the strip being woven in and out of the intervening strings a positions spaced from the crossing points of the transverse and longitudinal strings and so as to extend through the center of the hitting area.

The present invention is based on the objective of being able to provide a racket, especially a tennis racket, with a damping element which, in a simple manner, may at any time be easily exchangeable in place of a worn one or in place of one that has other damping characteristics, for example.

The noted objective of the present invention is achieved, in accordance with a preferred embodiment of the invention, through the provision of a rubber-like elastic band which is clamped exclusively in an edge area of the hitting area through crossing points of respective longitudinal and transverse strings.

By this measure, the strings of a racket can be dampened at any time corresponding to the selection of the string material and/or the tension of the strings and/or corresponding to the wishes and requirements of the player. For this purpose, the strip, in a simple manner, is slid under the respective crossing points of the strings and is clamped in-between. In particular, one obtains, by means of one or no more than two damping elements, a sufficient damping of the corresponding racket.

These and further objects, features and advantages of the present invention will become more obvious from the following description when taken in connection with the accompanying drawings which show, for purposes of illustration only several embodiments in accordance with the present invention.

BRIEF DESCRIPTION OF THE DRAWINGS

FIG. 1 shows a racket according to the invention; and

FIG. 2 is a partial view of the section II—II of FIG. 1 in an enlarged scale.

DETAILED DESCRIPTION OF THE PREFERRED EMBODIMENT

The frame of a racket 2, the hitting surface 3 of which has a string area consisting of longitudinal strings $L_1$ to $L_x$ and transverse strings $Q_l$ to $Q_y$, has the reference number 1. According to the invention, a strip 6 made of a rubber-elastic material is provided in the edge area 4, especially in the lower edge area 4 near the shaft 5.

The strip 6 is clamped between the longitudinal and transverse strings at the crossing points $K_l$, $K_3$, $K_5$, $K_7$ and $K_9$ which are formed by the longitudinal strings $L_4$, $L_6$, $L_8$, $L_{10}$ and $L_{12}$ and by the transverse string $Q_2$.

The width b of the strip 6 is smaller than twice the distance, a, between two adjacent transverse strings Q so that strip 6 can overly a string Q without having to contact an adjacent string Q on either side thereof. The width b, of the strip 6 measures about 0.1 to 3mm, and is selected corresponding to the desired damping characteristic and the material-dependent damping factor. The strip 6 may, for example, consist of natural rubber or synthetic rubber, such as a chlorinated rubber like neoprene. A soft PVC or another elastic plastic substance may also be used.

Even though the strip is already perfectly clamped in and held by the pressing force of the crossing points, an additional hook-shaped extension 8 may also be provided at the ends 7 of the strip 6 by means of which the strip 6 can be hooked onto the longitudinal string L that is located at each end, in which case the length of the strip is expediently set so that the strip will be placed slightly under tension, without the distance between the strings being changed. For reasons of simplicity, the drawing only shows an extension 8 at the end 7 on the left side. The inside radius 9 of the hook-shaped extension 8 is preferably smaller than the diameter of one string L or Q so as to securely grip the string onto which it is clipped.

In the lower edge area 4, the strip 6 is in each case clamped between alternate crossing points, such as $K_1$, $K_3$, $K_5$, etc. If, however, the strip in the edge area 4 is clamped diagonally, as shown for the strip 6', each adjacent diagonal crossing point K may be used to clamp the strip. An oblique position of, for example, 45° may be used if the distance of the longitudinal strings as well as of the transverse strings is the same. This will result in a still better damping effect.

Better damping may also be achieved when, in addition to the strip 6, a second strip 6'' is clamped below the strip 6 between the crossing points $K_2$, $K_4$, $K_6$, etc. skipped by the first strip 6. A portion of such a second strip is shown in FIG. 2 in the center of the drawing, and it should be understood that such a strip 6'' could be of comparable length to strip 6, but would have its hook-shaped extension directed in an opposite direction from that of strip 6 to grip a string K at one of the crossing points through which strip 6'' passes.

The mounting of the strips can be carried out in a simple manner by means of known string lifting devices.

Even though the main field of application of the invention concerns tennis rackets, it may also advantageously be used in other types of rackets, such as squash rackets, badminton rackets, racketball rackets and other rackets.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

I claim:

1. A racket having a hitting area strung with longitudinal and transverse strings disposed so as to form crossing points therebetween and having at least one detachable damping means, comprising at least one elastic strip in an assembled condition on the racket, said elastic strip being of a width which is smaller than twice the distance between two transverse strings, for the damping of string vibrations, wherein the elastic strip is located solely in an edge area of the hitting area and is clamped in a sandwiched relationship such that said elastic strip extends between the longitudinal string and the transverse string of at least two crossing points and wherein the elastic strip, starting from one crossing point, is successively clamped between longitudinal and transverse strings only at alternate crossing points.

2. A racket according to claim 1, wherein the strip has a hook-shaped extension on at least one of its ends.

3. A racket according to claim 2, wherein said damping means comprises at least a first and a second elastic strip said second elastic strip being located in overlying relationship with respect to said first elastic strip and being clamped in crossing points at which the first elastic strip does not pass between the respective longitudinal and transverse strings.

4. A racket according to claim 3, wherein the width of the strip measures 0.1 to 3mm.

5. A racket according to claim 2, wherein an inside radius of the hook-shaped extension is equal to or smaller than the thickness of the strings.

6. A racket according to claim 5, wherein the width of the strip measures 0.1 to 3mm.

7. A racket according to claim 5, wherein said damping means comprises at least a first and a second said elastic strip said second elastic strip being located in overlying relationship with respect to said first elastic strip and being clamped in crossing points at which the first elastic strip does not pass between the respective longitudinal and transverse strings.

8. A racket according to claim 7, wherein the elastic strips extend in parallel overlying relationship with respect to one of the strings without contacting parallelly extending, adjacent strings on either side of said one string.

9. A racket according to claim 8, wherein a strip, similar to said first elastic strip extends through diagonally adjacent crossing points of respective longitudinal and transverse strings.

10. A racket according to claim 1, wherein the elastic strip extends in parallel overlying relationship with respect to one of the strings without contacting parallelly extending, adjacent strings on either side of said one of the strings.

11. A racket according to claim 10, wherein another elastic strip extends through diagonally adjacent crossing points of respective longitudinal and transverse strings.

12. A racket according to claim 1, wherein the width of the strip measures 0.1 to 3mm.

13. A racket according to claim 11, wherein said damping means comprises at least a first and a second said elastic strip said second elastic strip being located in overlying relationship with respect to said first elastic strip and being clamped in crossing points at which the first elastic strip does not pass between the respective longitudinal and transverse strings.

14. A racket having a hitting area strung with longitudinal and transverse strings disposed so as to form crossing points therebetween and having at least one detachable damping means, comprising at least one elastic strip in an assembled condition on the racket, said elastic strip being of a width which is smaller than twice the distance between two transverse strings, for the damping of string vibrations, wherein the elastic strip is located solely in an edge area of the hitting area and is clamped in a sandwiched relationship such that said elastic strip extends between the longitudinal string and the transverse string of at least two crossing points and wherein said elastic strip, extends through diagonally adjacent crossing points of respective longitudinal and transverse strings.

15. A racket according to claim 14, wherein the elastic strip has a hook-shaped extension on at least one of its ends.

16. A racket according to claim 15, wherein an inside radius of the hook-shaped extension is equal to or smaller than the thickness of the strings.

17. A racket according to claim 16, wherein the width of the strip measures 0.1 to 3mm.

* * * * *